US008449186B2

(12) United States Patent
Bray

(10) Patent No.: US 8,449,186 B2
(45) Date of Patent: May 28, 2013

(54) MULTI-COMPARTMENT RESEALABLE STORAGE BAG

(76) Inventor: MaBelle Ericson Vaughan Bray, Sherman Oaks, CA (US)

( * ) Notice: Subject to any disclaimer, the term of this patent is extended or adjusted under 35 U.S.C. 154(b) by 393 days.

(21) Appl. No.: 12/474,250

(22) Filed: May 28, 2009

(65) Prior Publication Data

US 2009/0297069 A1 Dec. 3, 2009

Related U.S. Application Data

(60) Provisional application No. 61/056,440, filed on May 28, 2008.

(51) Int. Cl.
*B65D 30/22* (2006.01)
*B23P 17/00* (2006.01)

(52) U.S. Cl.
USPC ..... 383/38; 383/69; D9/709

(58) Field of Classification Search
USPC ..... 383/39, 69, 61.1, 61.3; D9/705, 702, D9/703, 709; D3/285
See application file for complete search history.

(56) References Cited

U.S. PATENT DOCUMENTS

| | | | | |
|---|---|---|---|---|
| 3,749,237 | A * | 7/1973 | Dorton | 206/438 |
| 6,254,907 | B1 * | 7/2001 | Galomb | 426/115 |
| D483,256 | S * | 12/2003 | Thurston | D9/663 |
| 2004/0066982 | A1 * | 4/2004 | Urman et al. | 383/6 |
| 2004/0179754 | A1 * | 9/2004 | Taheri | 383/38 |
| 2004/0247208 | A1 * | 12/2004 | Krohne | 383/42 |
| 2007/0026251 | A1 * | 2/2007 | Umana | 428/517 |
| 2007/0206888 | A1 * | 9/2007 | Chang | 383/200 |
| 2009/0034885 | A1 * | 2/2009 | McGruder | 383/37 |

* cited by examiner

*Primary Examiner* — Nathan J Newhouse
*Assistant Examiner* — Christopher Demeree
(74) *Attorney, Agent, or Firm* — Mintz Levin Cohn Ferris Glovsky and Popeo, P.C.

(57) ABSTRACT

A device having multiple resealable compartments for food storage is disclosed. The device is formed as a single unit and is comprised of several resealable compartments. Depending on the embodiment the number, shape and position of these compartments varies.

6 Claims, 5 Drawing Sheets

MULTI-COMPARTMENT RESEALABLE STORAGE BAG

FIELD OF THE INVENTION

The technology described herein relates generally to the field of devices for storage bags, and specifically relates to a device having multiple resealable compartments for food storage.

BACKGROUND OF THE INVENTION

Resealable food storage bags are known in the art. Common sizes of these bags are gallon, quart, pint and snack. One problem faced by parents in preparing food/snacks using these bags is that a child may want to keep different food items in separate bags. For example, a child may want miniature carrots in one bag, slices of apples in another bag, pretzels in another bag, grapes in another bag, etc. To accommodate this, a parent traditionally has to use multiple bags.

There is a need in the art for a resealable bag having multiple compartments with the sizes and shapes to address this problem.

BRIEF SUMMARY OF THE INVENTION

In various exemplary embodiments, the technology described herein provides a Multi-compartment resealable bag having multiple pouches (compartments) in one plastic bag. The material used can be a high clarity polypropylene. The bag is formed as a single unit comprised of several resealable compartments. Depending on the embodiment the number, shape and position of these compartments varies.

In one embodiment the bag is sectioned with two compartments on the top and a longer compartment for the bottom.

In another embodiment the bag is sectioned into four compartments.

In still another embodiment the bag has two triangular sections for the top portion with different sized compartments for the bottom portion.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

Figure 1:
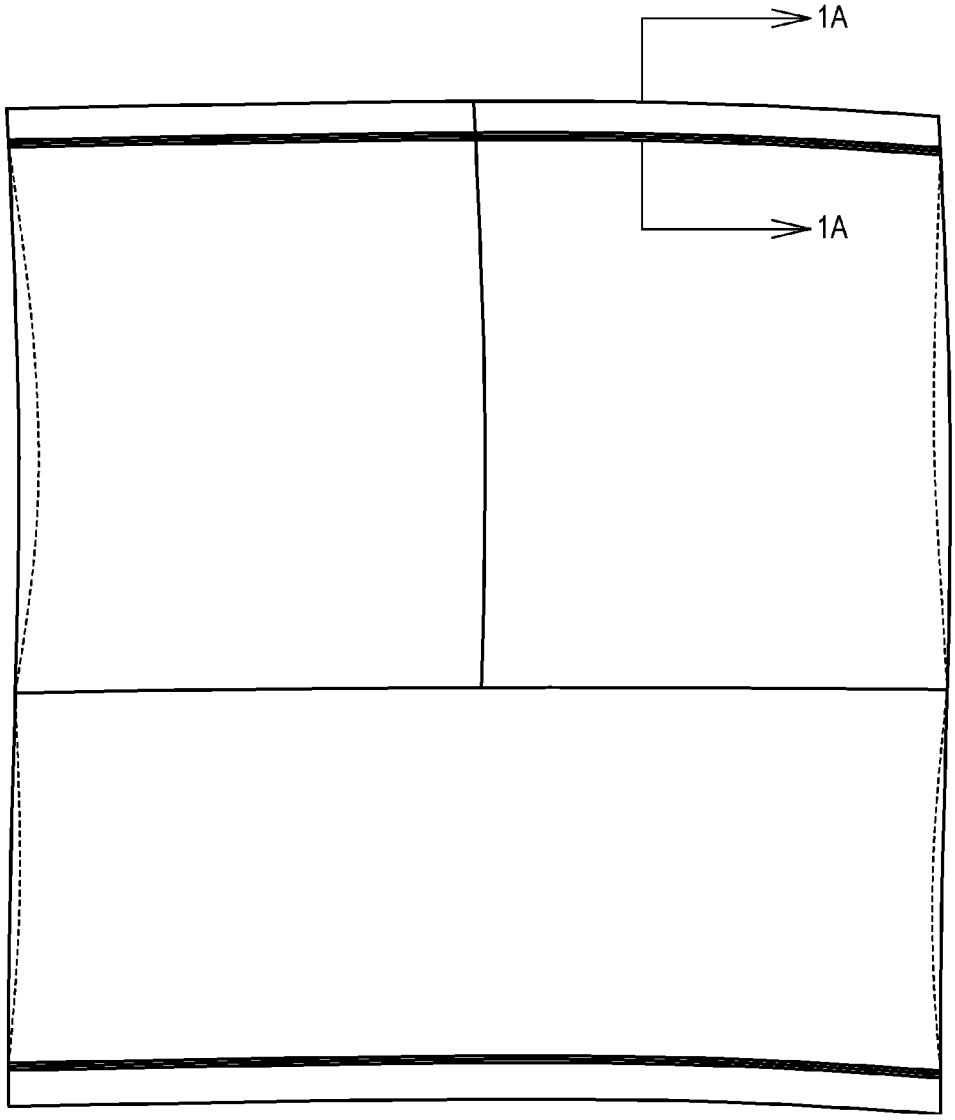
FIG. 1 illustrates a plan view of a three compartment bag with two smaller rectangular sections for the top portion and one larger rectangular section for the bottom portion, according to an embodiment of the technology.
Figure 1A:
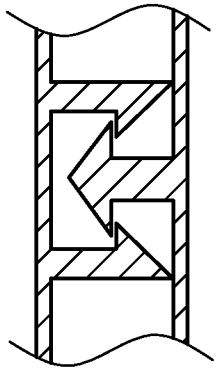
FIG. 1A illustrates a partial cross-sectional view of a resealing element, according to an embodiment of the technology.
Figure 2:
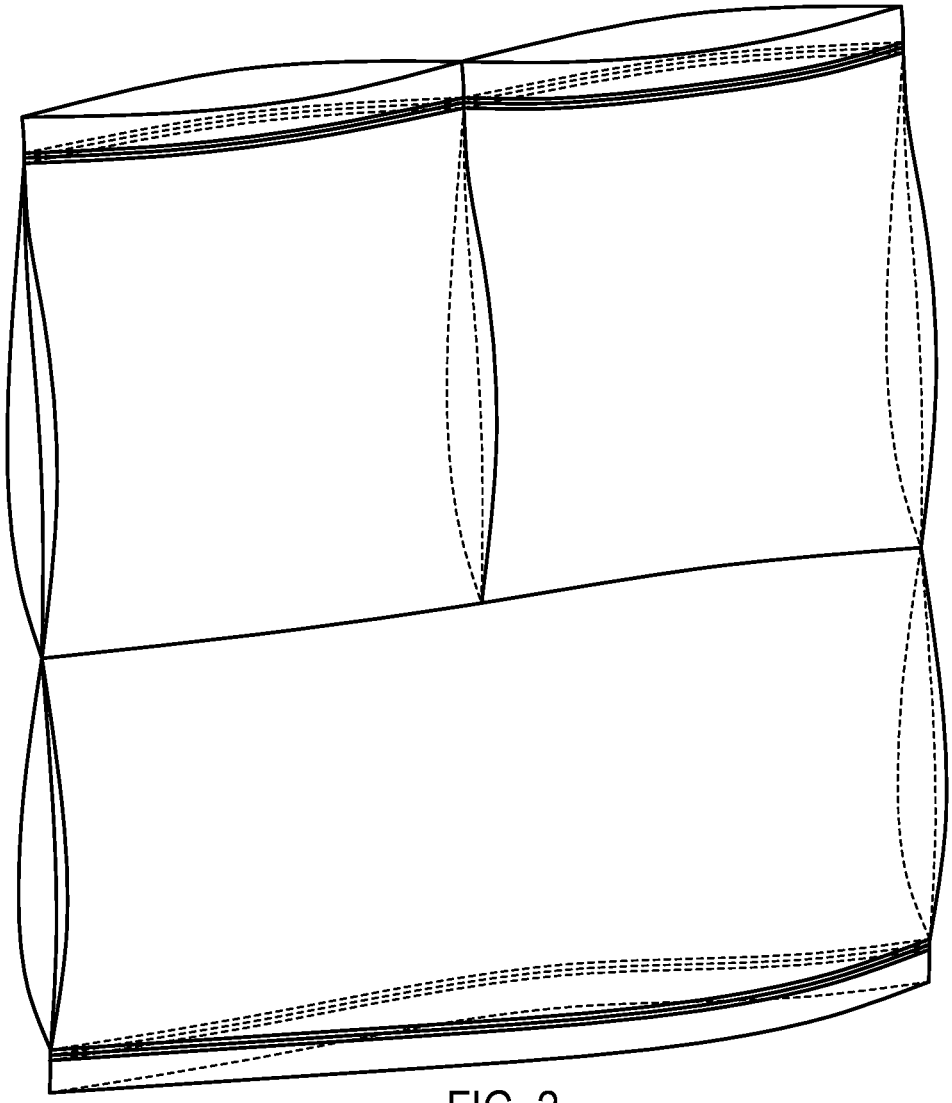
FIG. 2 illustrates a perspective view of FIG. 1, according to an embodiment of the technology.
Figure 3:
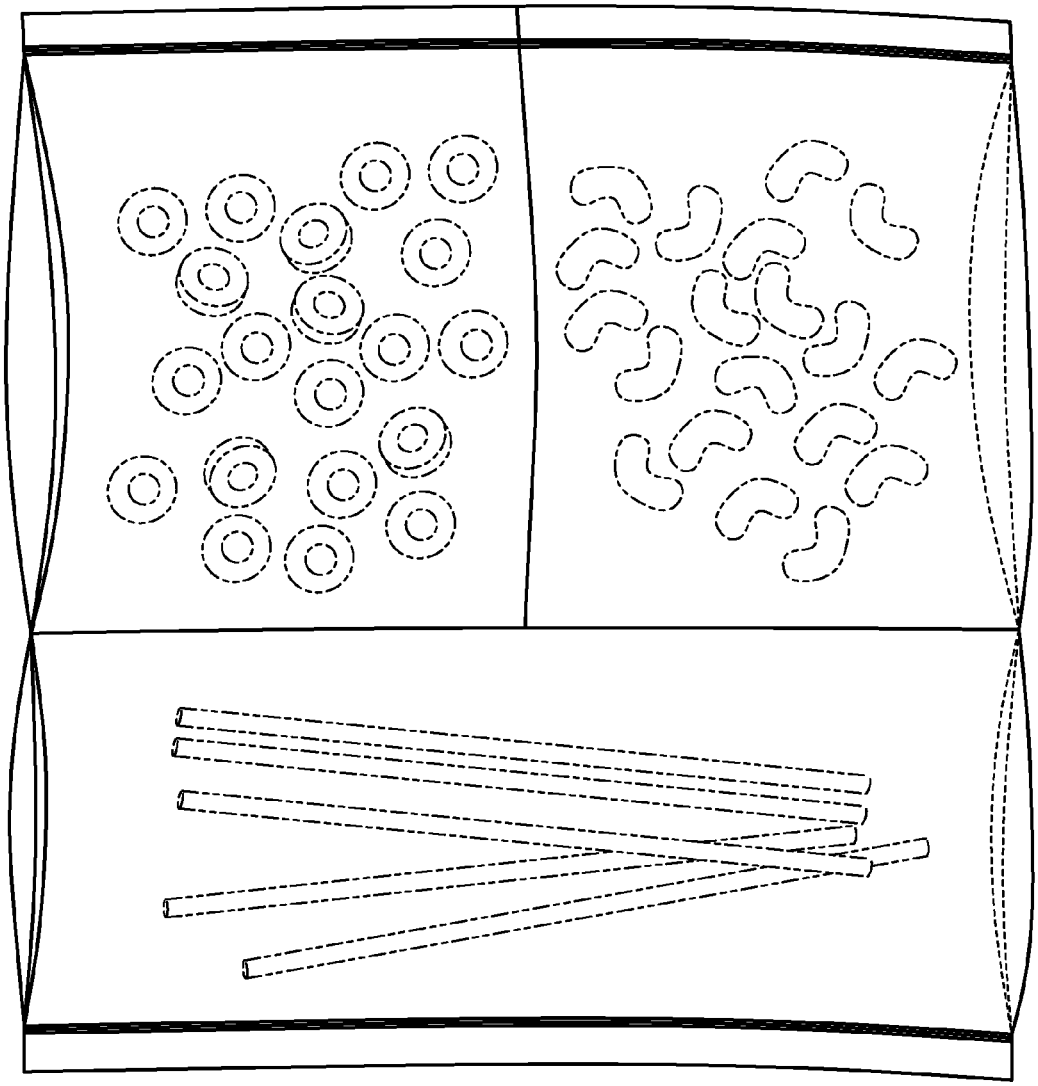
FIG. 3 illustrates food items stored within the compartments of FIG. 2, according to an embodiment of the technology.

Referring now to FIGS. 1, 2 and 3, a 3-pouch multi-compartment resealable bag is illustrated that has two compartments on the top, with a slid lock that allows a user to slide open one or two of the bags at the same time. The two top separated compartments are for an assortment of different foods. On the bottom, there is one long compartment that opens on its own side. The long compartment holds foods that are longer, or just to give more space for favorite munchies.

When taking this bag out of the cupboard the user may have a variety of fun finger food in mind. A caregiver's child may like to help the caregiver decide what goes into each compartment, or the child may want the caregiver to surprise him/her. Typical items to be stored can be strawberries, sliced apples, dried peas, hot dogs, or bread sticks. After cutting the apple slices the two smaller compartments of the bag are opened and first food item the apples in the first pouch than zips it across half way.

The multi-compartment bag also allows for a child's participation in the selection of the contents of each compartment. For example In the second pouch, a child decides that she wants the dried peas so she puts a handful of these in the second pouch than continues to zip the pouch the rest of the way shut.

For the third pouch that is long, a child decides she wants hot dogs, but not cut up, as she likes to hold them and bite them. She puts the hot dogs in and then zips the third pouch shut. She picks the bag up triumphantly and everything is in her grasp. She studies the assortment, grins than places it in her lunch box. She looks in and is very pleased that everything has its own spot, easy to see and neatly tucked away.

At school, she sits at the lunch table with all the other children. As they are having trouble-opening lids and containers and looking through bag after bag that jumbles together into a large mess, she takes out her multi-compartment resealable bag and unzips one side than the other; she dips a hand and grabs a hot dog than takes a bit. With the free hand, she digs into the dried peas and pops some into her mouth. The apples follow as she makes her round from one compartment to the next.

With the multi-compartment bags the food is easy to get to, no fuss or mess and the best part is when she is done, if there is still food left over, she can zip the bags back up for later or discard them and be on her way.

No tops opening or lids falling off to land in a heap on the bottom of her lunch box and best of all there is nothing to frustrate those little hands.

Another advantage is that if it is easy and simple and looks appealing then a child will spend less time trying to get to her food and more time eating it.

Another advantage is that teachers will spend less time going from child to child to help open items.

Figure 4:
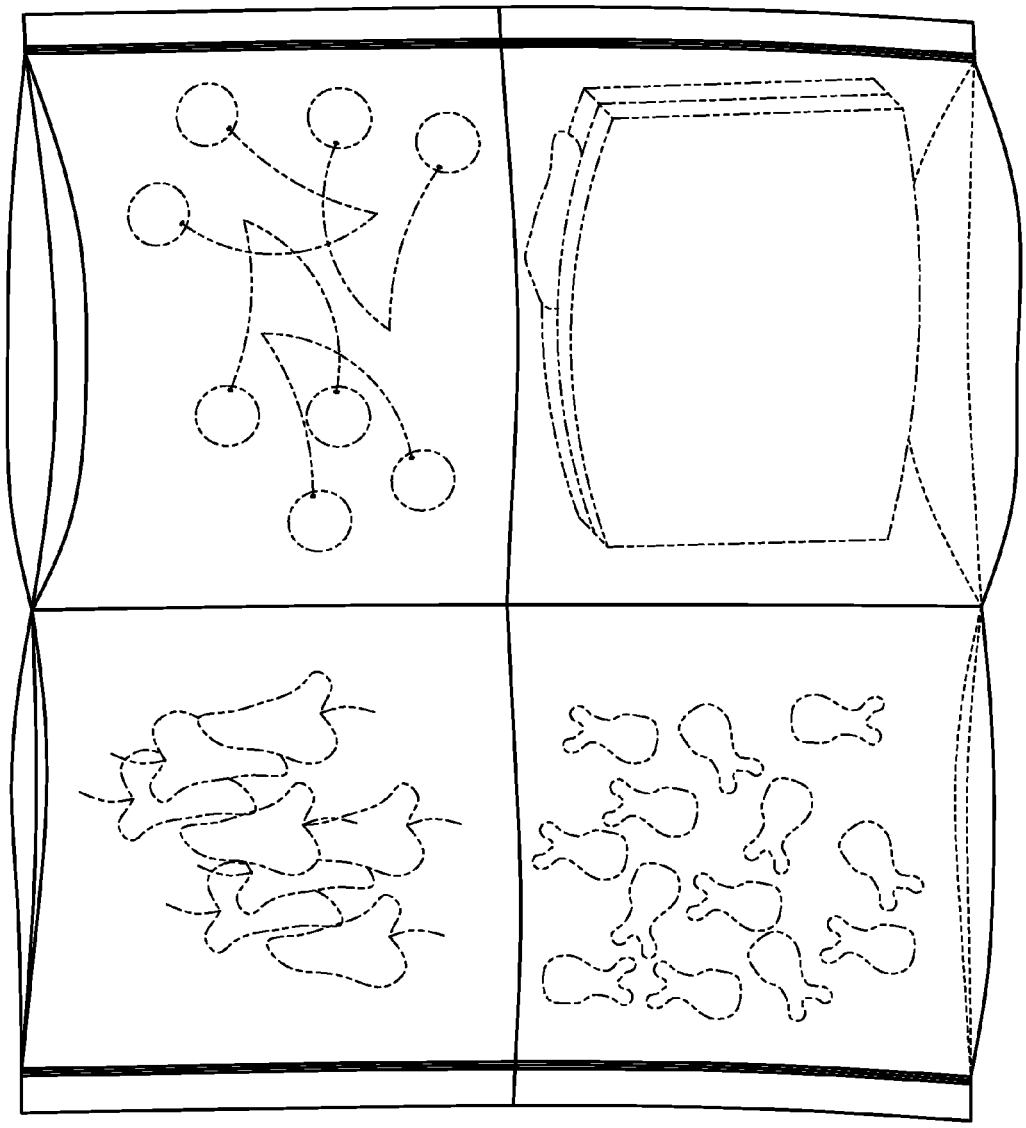
FIG. 4 illustrates a four compartment bag with each compartment having a rectangular shape and with food items stored within the four compartments, according to an embodiment of the technology.

Referring now to FIG. 4, the Multi-Compartment resealable four-section bag is illustrated.

Some children want variety. However, they do not always eat more than a few bites of everything. A caregiver can decide to surprise a child. In the first compartment, the caregiver can put a few slices of turkey, in the second compartment a few slices of cheese, in the third pouch, some crackers, and in the fourth compartment, some cut up grapes. All compartments are sealed and the multi-compartment bag is placed in the child's lunch box.

At school when the child opens her lunch box she is very happy to see that she has the choice of eating one thing at a time or making her very own sandwich. She unzips both sides and takes out a piece of turkey, a piece of cheese, and two crackers; with this she decides a build-it-yourself sandwich is the way to go. The grape is a good in-between dipping. After finishing her first creation she decides that she wants some crackers on their own and then goes for the turkey and cheese later.

Figure 5:
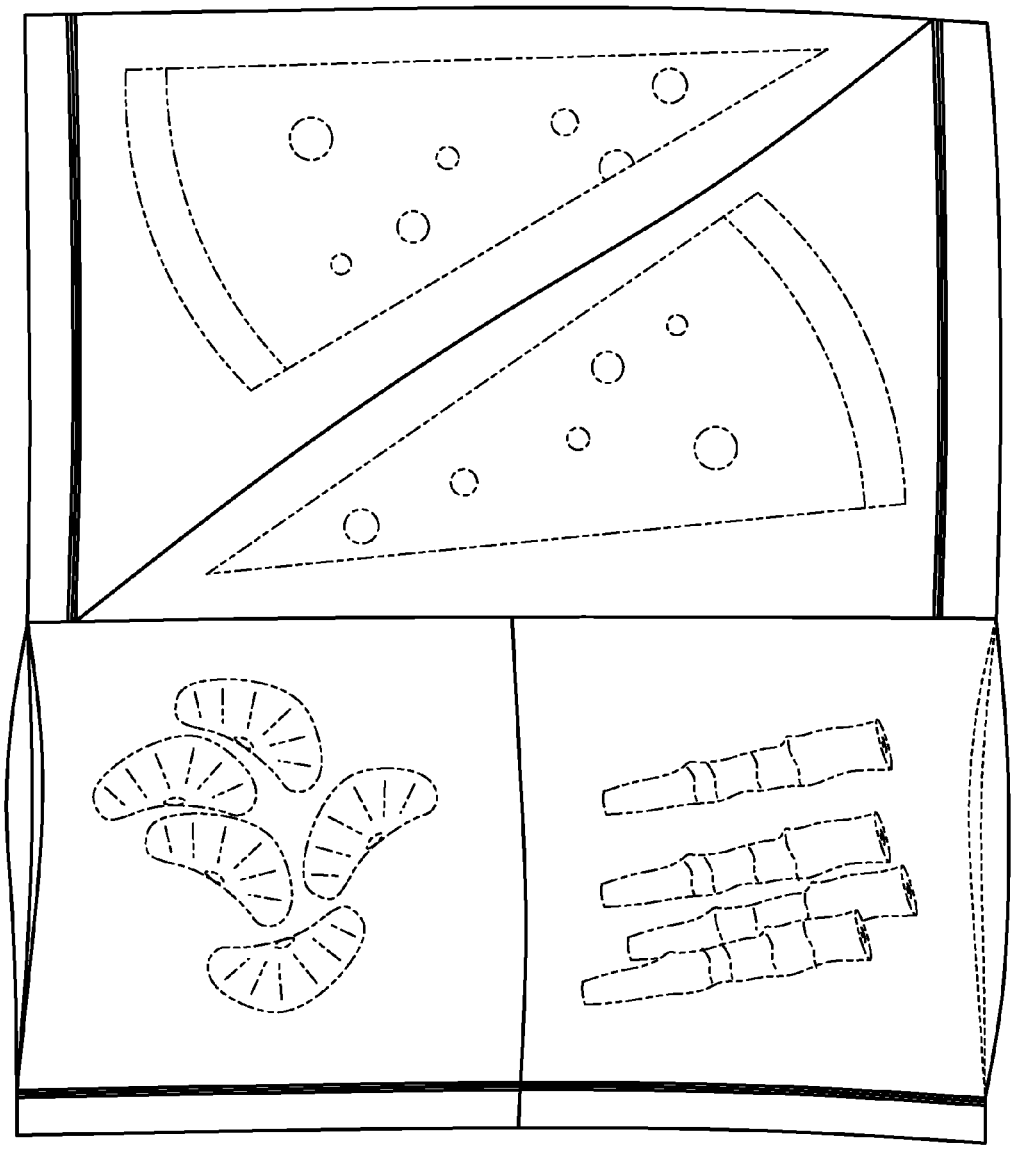
FIG. 5 illustrates a four compartment bag having two triangular compartments and two rectangular compartments.

Referring now to FIG. 5, a different embodiment of a four-section multi-compartment bag is illustrated. The top two compartments of the multi-compartment resealable bag are triangular and are ideal for pizza slices, and the two compartments on the bottom are for other individualized items to be stored.

The caregiver unzips the top two sides and puts in a pizza slice in each compartment. Than on the bottom the caregiver can unzip the other two pouches, in one put strawberries and in the other, put in broccoli. The caregiver zips up all the compartments and places the multi-compartment pizza bag into the child's lunch box.

At school, the child unzips one side and takes out her first piece of pizza than unzips the other side. She unzips the other two compartments and digs into the broccoli, then the strawberries. This is easy and simple for parent, child and teachers.

In various exemplary embodiments, the technology described herein is detailed in the following items:

1. A multi-compartment resealable storage bag comprising:
   a plurality of storage compartments disposed within a multi-compartment resealable bag, each storage compartment having a front and a back and an opening configured for sealable closure; and
   a plurality of resealable closures configured to sealably close each opening of the plurality of storage compartments.
2. The multi-compartment resealable storage bag of Item 1, where the plurality of storage compartments are adjacent to one another and connected by a plurality of sealed seams in the multi-compartment resealable storage bag.
3. The multi-compartment resealable storage bag of Item 1, where the multi-compartment resealable storage bag is comprised of a thin, flexible, plastic material.
4. The multi-compartment resealable storage bag of Item 1, where the multi-compartment resealable storage bag is comprised of high clarity polypropylene.
5. The multi-compartment resealable storage bag of Item 1, where each of the plurality of storage compartments are varied in size and shape.
6. The multi-compartment resealable storage bag of Item 1, where plurality of resealable closures is comprised of sealable zippered closures.
7. The multi-compartment resealable storage bag of Item 1, further comprising:
   a plurality of sliders, each slider configured to seal the closure as it is slid across the opening of the storage compartment.
8. The multi-compartment resealable storage bag of Item 7, where the slider is configured to seal more than one closure.
9. The multi-compartment resealable storage bag of Item 1, where the plurality of storage compartments is comprised of two upper compartments disposed adjacently on a top portion of the multi-compartment resealable storage bag and a lower compartment disposed on the multi-compartment resealable storage bag below the two upper compartments, the two upper compartments being sealably closed by an upper zipper closure and the lower compartment being sealably closed by a lower zipper closure.
10. The multi-compartment resealable storage bag of Item 1, where the plurality of storage compartments is comprised of two upper compartments disposed adjacently on a top portion of the multi-compartment resealable storage bag and two lower compartments disposed adjacently on the multi-compartment resealable storage bag below the two upper compartments, the two upper compartments being sealably closed by an upper zipper closure and the two lower compartments being sealably closed by a lower zipper closure.
11. The multi-compartment resealable storage bag of Item 1, where the plurality of storage compartments is comprised of rectangular shaped compartments.
12. The multi-compartment resealable storage bag of Item 1, where the plurality of storage compartments is comprised of triangular shaped compartments.
13. A method for manufacturing a multi-compartment resealable storage bag, the method comprising:
   providing a plurality of storage compartments disposed within a multi-compartment resealable bag, each storage compartment having a front and a back and an opening configured for sealable closure; and
   providing an at least one closure configured to sealably close the opening of at least one of the plurality of storage compartments;
   where the plurality of storage compartments are adjacent to one another and connected by a plurality of sealed seams in the multi-compartment resealable storage bag.
14. The method of Item 13, further comprising:
   utilizing high clarity propylene for the manufacture of the multi-compartment resealable storage bag.

15. The method of Item 13, further comprising:
utilizing a plurality of sliders, each slider disposed upon one or more closures, configuring the slider to seal the one or more closures as it is slid across the opening of the storage compartment.

16. The method of Item 13, where the plurality of storage compartments is comprised of two upper compartments disposed adjacently on a top portion of the multi-compartment resealable storage bag and a lower compartment disposed on the multi-compartment resealable storage bag below the two upper compartments, the two upper compartments being sealably closed by an upper zipper closure and the lower compartment being sealably closed by a lower zipper closure.

17. The method of Item 13, where the plurality of storage compartments is comprised of two upper compartments disposed adjacently on a top portion of the multi-compartment resealable storage bag and two lower compartments disposed adjacently on the multi-compartment resealable storage bag below the two upper compartments, the two upper compartments being sealably closed by an upper zipper closure and the two lower compartments being sealably closed by a lower zipper closure.

18. The method of Item 13, where the plurality of storage compartments is comprised of rectangular shaped compartments.

19. The method of Item 13, where the plurality of storage compartments is comprised of triangular shaped compartments.

20. A multi-compartment resealable food storage bag comprising:
a plurality of food storage compartments disposed within a high clarity polypropylene multi-compartment resealable bag, each food storage compartment having a front and a back and an opening configured for sealable closure;
a plurality of zippered closures configured to sealably close the opening of at least one of the plurality of storage compartments; and
a plurality of sliders, one slider disposed upon one or more of the plurality of zippered closures, each slider configured to seal each zippered closure as it is slid across the opening of the storage compartment;
where the plurality of storage compartments are adjacent to one another and connected by a plurality of sealed seams in the multi-compartment resealable storage bag; and
where varied food products are individually storable within the plurality of food storage compartments within a single multi-compartment resealable food storage bag.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A storage apparatus comprising:
a multi-compartment bag formed of a flexible material, each compartment of the multi-compartment bag having two or more sealed edges and one resealable opening edge, the multi-compartment bag having a front surface, a back surface, and a generally rectangular peripheral edge defined by a top edge, a bottom edge, and opposing side edges, the multi-compartment bag having two or more rectangular compartments in a lower portion of the multi-compartment bag, each of the rectangular compartments having their resealable opening edge along the bottom edge of the multi-compartment bag, the multi-compartment bag having at least one pair of substantially right triangular compartments in an upper portion of the multi-compartment bag, each of the right triangular compartments being arranged such that one of their sealed edges is a common sealed edge at their respective hypotenuses, and each of the right triangular compartments having their resealable opening edge along the opposing side edges of the multi-compartment bag perpendicular to the bottom edge of the multi-compartment bag.

2. The storage apparatus in accordance with claim 1, wherein the flexible material includes polypropylene.

3. The storage apparatus in accordance with claim 1, wherein at least one of the resealable opening edges includes a slider to seal the at least one resealable opening edge.

4. The storage apparatus in accordance with claim 1, wherein the flexible material is translucent.

5. The storage apparatus in accordance with claim 1, wherein only one of the front surface or back surface of the multi-compartment bag is translucent.

6. The storage apparatus in accordance with claim 5, wherein the translucent front surface or back surface of the multi-compartment bag is formed of polypropylene.

* * * * *